US007044513B2

(12) United States Patent
Witiak et al.

(10) Patent No.: US 7,044,513 B2
(45) Date of Patent: May 16, 2006

(54) WEATHER RESISTANT LATCH HANDLE ASSEMBLY

(75) Inventors: Larry Witiak, Columbia, SC (US); Dennis Sadler, Irmo, SC (US)

(73) Assignee: Hansen International, Lexington, SC (US)

( * ) Notice: Subject to any disclaimer, the term of this patent is extended or adjusted under 35 U.S.C. 154(b) by 3 days.

(21) Appl. No.: 10/862,029

(22) Filed: Jun. 4, 2004

(65) Prior Publication Data

US 2005/0110283 A1 May 26, 2005

Related U.S. Application Data

(60) Provisional application No. 60/525,001, filed on Nov. 25, 2003.

(51) Int. Cl.
*E05B 3/00* (2006.01)

(52) U.S. Cl. ..... 292/336.3; 292/DIG. 31; 292/356; 292/358; 277/639; 277/910

(58) Field of Classification Search ..... 292/336.3, 292/DIG. 31, 356, 347, 358, 348, DIG. 30, 292/113; 277/639, 910, 637
See application file for complete search history.

(56) References Cited

U.S. PATENT DOCUMENTS 2,401,379 A 6/1946 Smith
2,570,117 A 10/1951 Hallstrand
2,795,441 A 6/1957 Gilbert et al.
3,179,423 A 4/1965 McCloud
3,510,155 A 5/1970 Jacobus
3,595,585 A * 7/1971 Bristow ..... 277/500
3,951,419 A 4/1976 Abrahams et al.
4,161,316 A 7/1979 Nowack et al.
4,258,902 A 3/1981 Liebert et al.
4,303,250 A 12/1981 Persson
5,000,463 A 3/1991 Sun
5,050,895 A 9/1991 Hashish et al.
5,064,228 A * 11/1991 Bisbing ..... 292/54
5,413,391 A * 5/1995 Clavin et al. ..... 292/170
5,638,709 A * 6/1997 Clavin ..... 70/208
5,653,449 A 8/1997 Martin
5,983,682 A 11/1999 Parikh

* cited by examiner

*Primary Examiner*—Brian E. Glessner
*Assistant Examiner*—Mark Williams
(74) *Attorney, Agent, or Firm*—McNair Law Firm, P.A.

(57) ABSTRACT

A weather resistant latch handle assembly including a pan having sidewalls with an opening from an interior side of the pan to an exterior side of the pan, a pan floor, and a recessed area defined by the sidewalls and the floor. Bushings are carried in the openings having an inner surface for receiving an actuator which extends from the exterior side of the pan to the interior side, and an outer surface for engaging the sidewall. A first annular groove is included in the inner surface of the bushing carrying a first o-ring for forming a seal between the inner surface of the bushing and the actuator. A second annular groove is included in the outer surface of the bushing carrying a second o-ring for forming a seal between the bushing and sidewall.

21 Claims, 4 Drawing Sheets

WEATHER RESISTANT LATCH HANDLE ASSEMBLY

CROSS REFERENCE TO RELATED APPLICATION

This application claims the benefit U.S. Provisional Application No. 60/525,001, entitled "Weather Resistant Latch Seal Assembly," filed Nov. 25, 2003.

FIELD OF THE INVENTION

The present invention relates to weather resistant latches, and more particularly, to a weather resistant seal for a latch handle assembly used in the closure of doors and compartment covers exposed to outdoor environments, which prevents water and debris from passing from the exterior latch handle assembly to the door latch mechanism on the compartment interior.

BACKGROUND OF THE INVENTION

In the manufacture of latches and seal assemblies, particularly for containers exposed to outdoor environments and harsh weather, it is advantageous to be able to install a weather resistant latch for the securing doors and compartment covers. Paddle latch handle assembly typically include a latch pan that is used to mount a handle in a door for operating a latch mechanism within the door. The latch pan often includes a recess in which a paddle handle is carried. The paddle handle is typically affixed to an actuator member, often in the form of a cylindrical bar, that is rotatably mounted in the sides of the latch pan. The actuator member carries the paddle handle and extends from the outside of the latch pan to the inside of the latch pan. When the paddle handle is rotated, the actuator member is also rotated to operate the latching mechanisms to open the door. A major problem with latch designs of this type is that water and debris can pass into the interior of the compartment at the point where the actuator member passes through the latch pan sides since holes are provided in the latch pan for rotatably accommodating the actuator member.

To address this problem, it is advantageous to provide a weather resistant seal assembly around the latch actuator members which prevents water and debris from entering the compartment interior along the actuator members. Additionally, it is advantageous to provide such a weather resistant seal assembly that is capable of being installed in the latch pans of existing latch handle assembly without requiring counter-boring or other additional machining of the latch pan to install the seal assembly.

While weather resistant latches are generally known, they require that the latch pan, actuating member and seal be machined together and do not lend themselves to retrofitting or use with existing latch pans without additional machining. For example, U.S. Pat. Nos. 2,401,379 and 3,595,585 are directed to seal assemblies, but if used on the actuating member of a latch pan, would require that the wall of the latch pan be counter-bored in order for these seal assemblies to be installed effectively. However, the walls of latch pans are so thin that such a counter-boring procedure cannot effectively be performed.

Therefore, it is an object of the present invention to provide for a seal assembly that can be used to provide a weather resistant latch handle assembly, and which can be retrofitted for use in existing latch pans without additional machining of the latch pan and seal assembly.

SUMMARY OF THE INVENTION

The above objectives are accomplished according to the present invention by providing a weather resistant latch handle assembly having a pan having a perimeter flange, at least one sidewall, the at least one sidewall having an opening from an interior side of the pan to an exterior side of the pan, a pan floor, and a recessed area defined by the at least one sidewall and the pan floor. A bushing is carried in the opening having an inner surface for receiving an actuator which extends from the exterior side of the pan to the interior side, and an outer surface for engaging the sidewall. A first annular groove is included in the inner surface of the bushing, and a second annular groove is included in the outer surface of the bushing. A first o-ring is carried by the first annular groove for engaging the actuator to form a seal between the inner surface of the bushing and the actuator. A second o-ring is carried in the second annular groove for engaging the exterior side of the sidewall to form a seal between the bushing and the sidewall. Also, a handle is affixed to the actuator for rotating the actuator to operate the latch mechanism and open a compartment door.

In a particularly advantageous embodiment, at least one spacing member is disposed between the inner surface of the bushing and the actuator for limiting compression of the first o-ring by the actuator to prevent damage to the first o-ring. In one embodiment, the at least one spacing member is a knot protruding from the inner surface of the bushing and engaging the actuator. In another embodiment, the at least one spacing member is a ridge protruding circumferentially from the inner surface of the bushing and engaging the actuator. Preferably, the first annular groove is disposed between a pair of ridges protruding from the inner surface of the bushing and adjacent the first o-ring carried in the first annular groove.

In a preferred embodiment, the outer surface of the bushing includes a vertical face positioned in face-to-face engagement with the exterior side of the sidewall, and the second annular groove recessed in the vertical face of the outer surface adjacent the sidewall.

Advantageously, an annular insert portion is also included in the bushing that extends from the exterior side of the sidewall to the interior side. A securing flange radially extends outward from the annular insert portion on the interior side of the pan and engaging the interior side of the sidewall.

Preferably, the latch handle assembly includes a locking member carried in the recessed area of the pan for engaging the paddle handle. The locking member has an engaged position wherein the paddle handle is restrained within the recessed area, and a disengaged position wherein the paddle handle is free to rotate the actuator. Further, it is preferred that the latch handle assembly include a bias member carried in the recessed area of the pan for engaging the paddle handle when the handle is positioned in the recessed area to direct the handle out of the recessed area when the locking member is disengaged.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
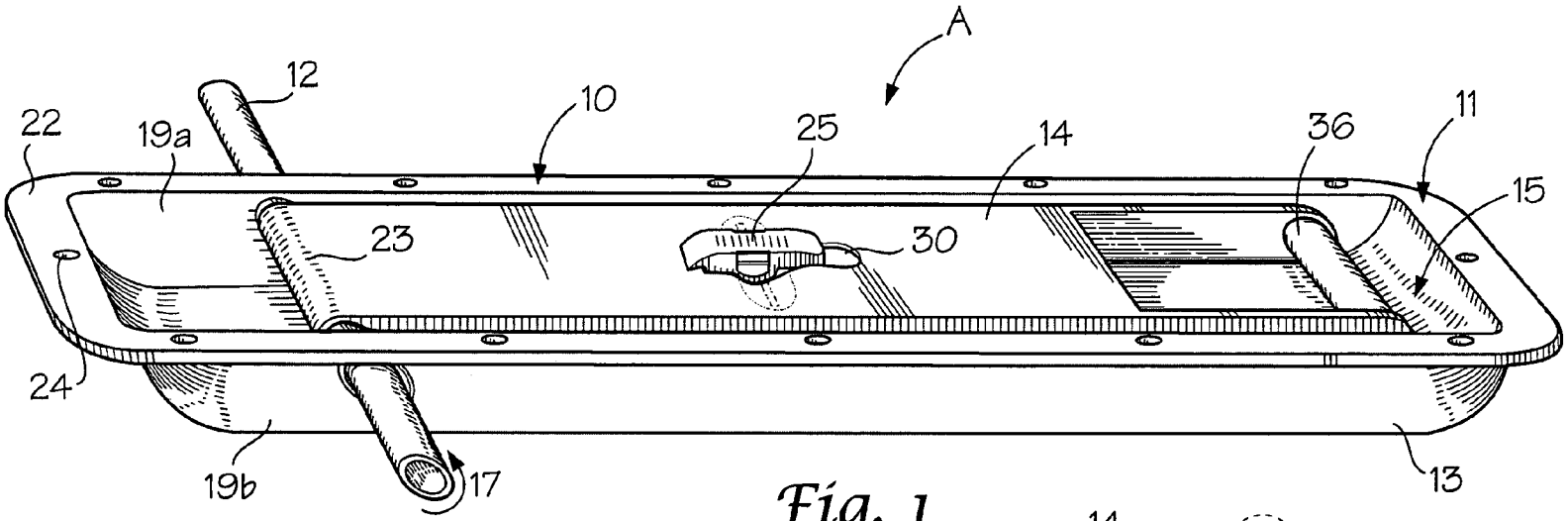
FIG. 1 is a perspective view of the latch handle assembly with a paddle handle in a closed position according to the present invention.
Figure 2:
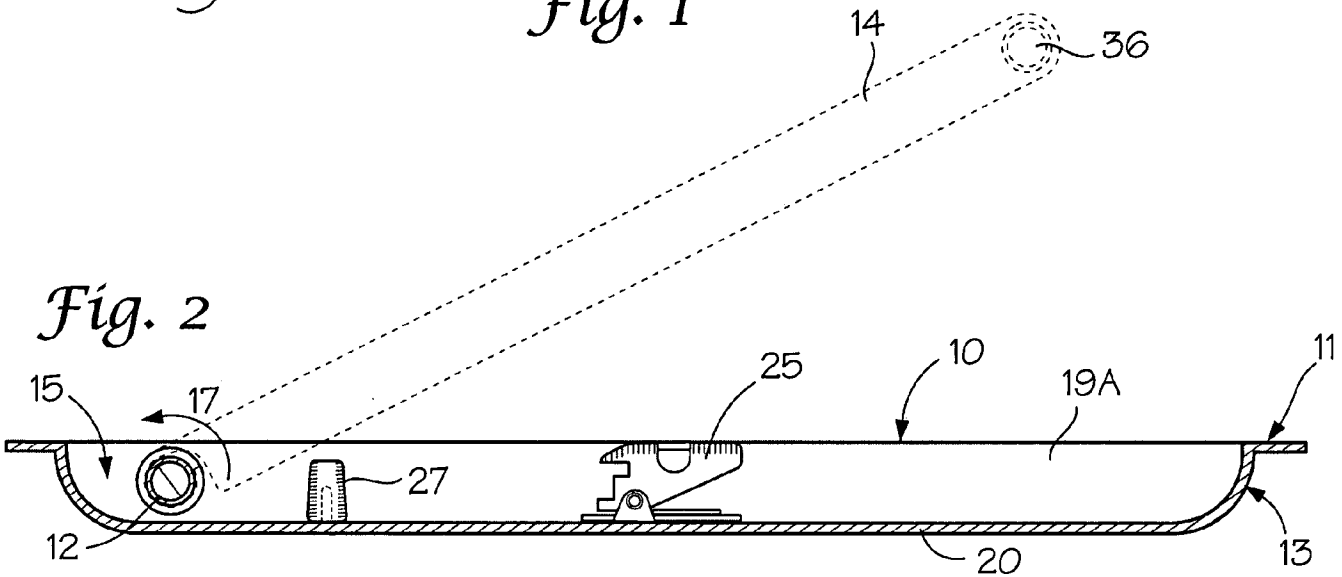
FIG. 2 is a side view of the latch handle assembly with the paddle handle in an open position according to the present invention.

Referring to the drawings, the invention will now be described in more detail. Referring to FIGS. 1 and 2, a weather resistant latch handle assembly, designated generally as A, is shown for use in securing doors and compartment covers exposed to outdoor environments. The latch may also be used on interior doors and the like, but is designed to withstand the elements that would adversely affect a non-weather resistant latch. Illustrated only for the purpose of example, the embodiment shown in FIGS. 1 and 2 includes a latch pan, designated generally as 10, having an exterior side, designated generally as 11, and an interior side designated generally as 13. Pan 10 includes a recessed area, designed generally as 15, defined by sidewalls 19*a*, 19*b* and pan floor 20. A perimeter flange 22 is carried around the edge of pan 10 that includes a plurality of mounting holes 24 for receiving securing members to secure the pan to a door. Pan 10 can be mounted so that the latch pan interior side is disposed within the interior of the container or door.

A paddle handle 14 is receiving in recessed area 15 between sidewalls 19*a* and 19*b* in a generally flush arrangement with perimeter flange 20 when in the closed position shown in FIG. 1. Paddle handle 14 is carried within the recessed area by an actuator 12. Actuator 12 is a generally cylindrical rod which is affixed to distal end 23 of paddle handle 14 and is rotated by movement of the paddle handle. Actuator 12 is rotatably carried in sidewalls 19*a* and 19*b* such that the actuator extends from exterior side 11 to interior side 13 to operate the latch mechanism (not pictured) when the paddle handle is moved to the open position as shown in FIG. 2. Paddle handle 14 is attached to actuator 12 so that lifting the handle from the closed position of FIG. 1 to the open position of FIG. 2 causes the actuator to rotate in a direction 17. The rotation of actuator 12 can be used to operate a latching means, or other securing means, to secure doors or hatches of a container.

Additionally, in a preferred embodiment, a locking member 25 is carried within recessed area 15 for engaging the handle to hold the handle in the closed position until released. Locking member 25 extends from pan floor 20 and into opening 30 of handle 14 and engages the handle for securing the handle in the closed position. Locking member 25 has an engaged position as shown in FIG. 1 wherein handle 14 is retrained within recessed area 15, and a disengaged position as shown in FIG. 2 wherein handle 14 is free to rotate actuator 12 in direction 17.

Preferably, a bias member 27 is carried by the latch pan in recessed area 15 for engaging handle 14 when the handle is positioned in the closed position to cause an outward bias on the handle to direct the handle out of the recessed are when the locking member is disengaged. By causing such a bias, the handle can be caused to extend slightly out from the latch pan when unlocked to allow for easier access to a hand grip 36 carried by the paddle handle. In one embodiment, bias member 27 is a rubber stopper which biases the paddle handle towards the open position when being held in the closed position by locking member 25.

Figure 3:
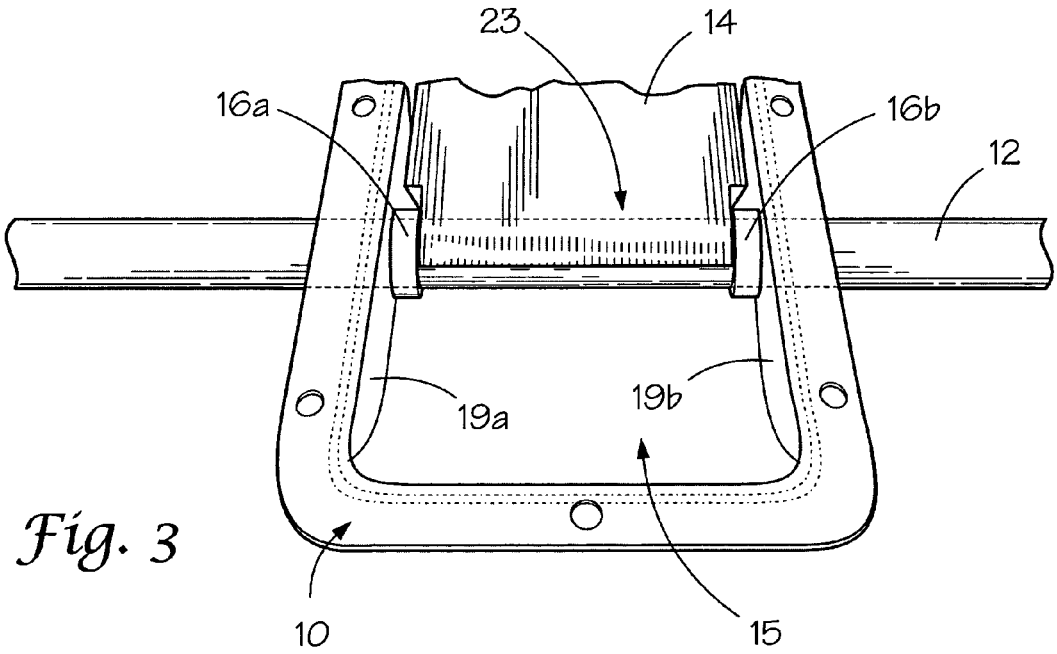
FIG. 3 is a top view of a portion of the latch handle assembly that carries the actuator member according to the present invention.

FIG. 3 further shows the relationship between actuator 12, handle 14, and latch pan 10. Actuator 12 is carried in sidewalls 19*a* and 19*b* by weather resistant bushing assemblies 16*a* and 16*b*, respectively. In this figure, paddle handle 14 is welded, by way of example only, to actuator 12 so that lifting the handle away from latch pan 10 causes actuator 12 to rotate as described above.

Figure 4:
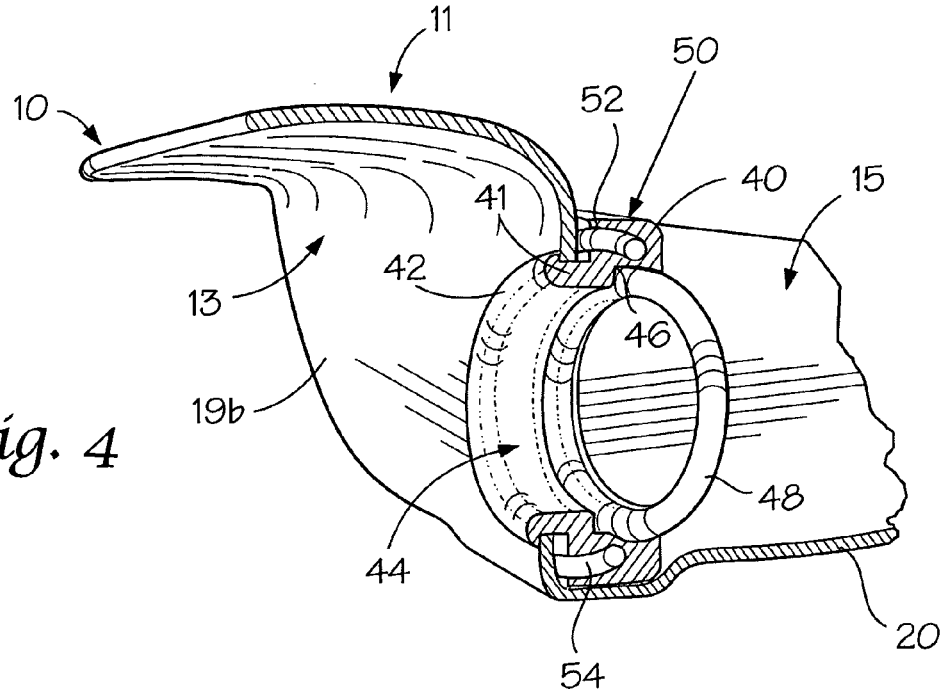
FIG. 4 is a cut-away perspective view of a bushing carried by the latch handle assembly facing the interior side according to the present invention.
Figure 5:
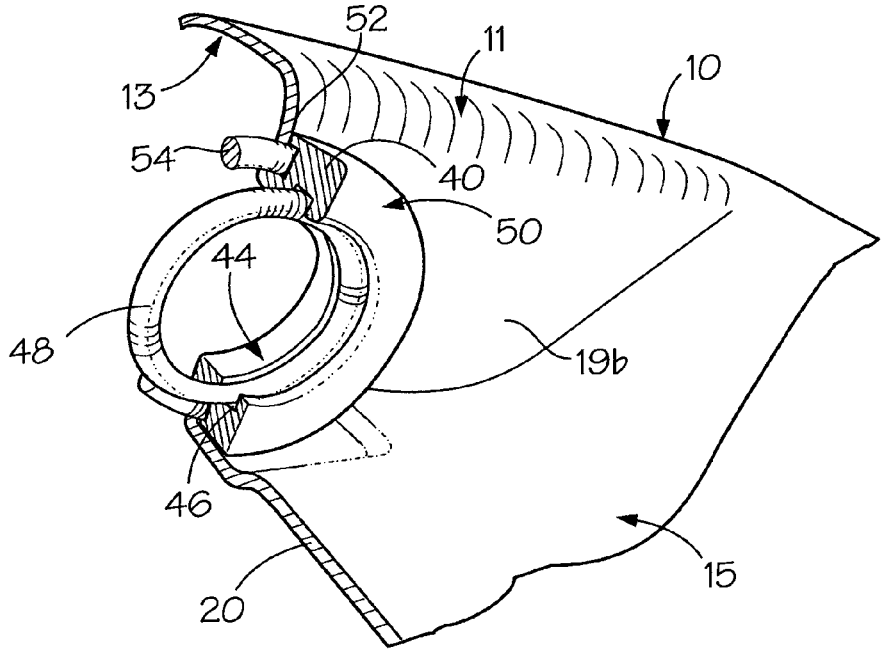
FIG. 5 is a cut-away perspective view of a bushing carried by the latch handle assembly facing the exterior side according to the present invention.
Figure 6:
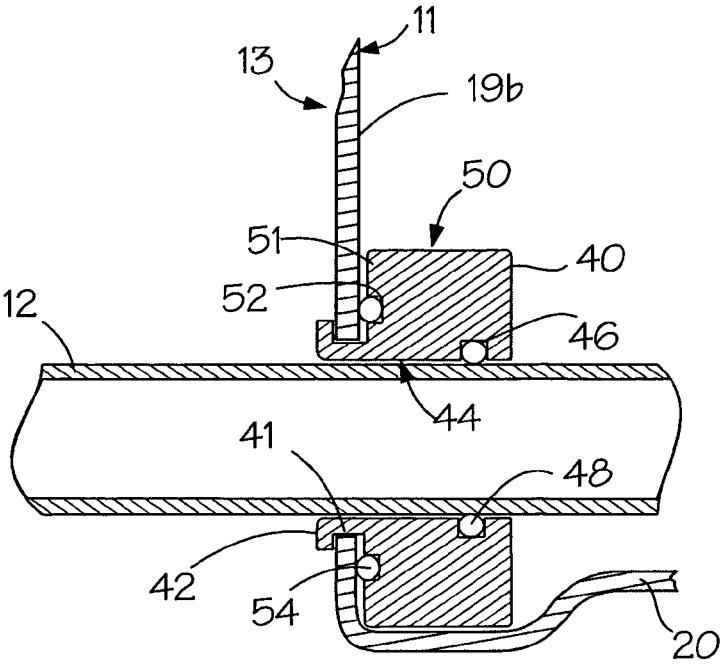
FIG. 6 is a cross-section view of the bushing carried by the latch handle assembly according to the present invention; and, FIG. 7 is a cross-section view of an alternative embodiment of the bushing carried by the latch handle assembly according to the present invention.

Referring to FIGS. 4, 5 and 6, each of bushing assemblies 16*a* and 16*b* include a bushing 40 carried by sidewalls 19*a* and 19*b* of latch pan 10 through which actuator 12 is received. As best shown in FIG. 4, bushing 40 is inserted into an opening in sidewall 19*b* of the latch pan without having to counter-bore the latch pan to receive the bushing and hold the bushings in place. To secure the bushing in the sidewall, an annular insert portion 41 is included in bushing 40 that extends through the opening in the sidewalls from exterior side 11 of the pan to interior side 13. The end of annular insert portion 41 on interior side 13 of pan 10 is then crimped to form a securing flange 42 that extends radially outward from the annular insert portion to engage interior side 13 of the sidewalls 19*a* and 19*b*, respectively, and hold the bushings securing in the openings of the sidewalls.

Each of bushings 40 is further defined as having an inner surface, designated generally as 44, which includes a first annular groove 46 for receiving a first o-ring 48. Actuator 12 is received by inner surface 44 of the bushing and is engaged by first o-ring 48 to form a weather resistant, and preferably watertight, seal between actuator 12 and first o-ring 48. Thus, as best shown in FIG. 6, first o-ring 48 is disposed between inner surface 44 of bushing 40 and actuator 12 received in the bushing to form a seal between the bushing and the actuator to prevent fluids and other foreign materials from passing from exterior side 11 of latch pan 10 to interior side 13 along the actuator.

Additionally, each of bushings 40 is defined as having an outer surface, designated generally as 50, which includes a second annular groove 52 for receiving a second o-ring 54. Referring to FIG. 6, outer surface 50 of bushing 40 includes a vertical face 51 positioned in face-to-face engagement with the exterior side of sidewall 19*b*, and second annular groove 52 is recessed in the vertical face of the outer surface adjacent the sidewall. When the bushing is mounted in the latch pan, second o-ring 54 is disposed between exterior surface 11 of sidewall 19*a* and 19*b* of the latch pan and outer surface 50 of bushing 40 to form a seal between the bushing and the latch pan so that a weather resistant seal is formed to prevent fluids and other foreign materials from passing from the exterior side of the latch pan to the interior side of the latch pan and therefore protecting the interior of a container and workings of the latch.

Figure 7:
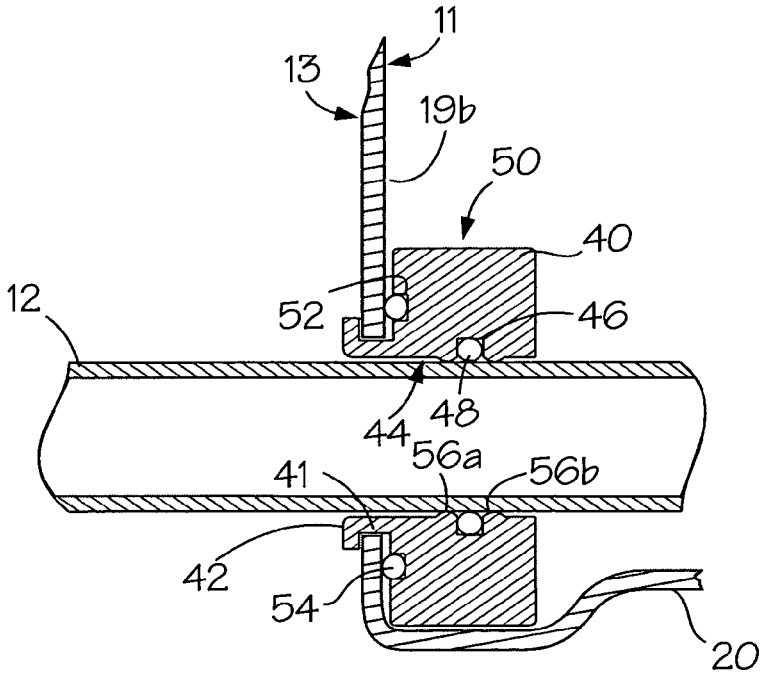

Referring now to FIG. 7, a further advantageous embodiment is shown in which at least one spacing member, indicated by reference numbers 56*a* and 56*b*, is disposed between inner surface 44 of bushing 40 and actuator 12 for limiting compression of first o-ring 48 by the actuator to prevent damage to the first o-ring. In one embodiment, the at least one spacing member 56*a* and 56*b* is at least one knot protruding from inner surface 44 of the bushing and engaging the actuator to prevent the actuator from over-compressing first o-ring 48. In another embodiment, the at least one spacing member 56*a* and 56*b* is a ridge protruding circumferentially from inner surface 44 of bushing 40 and engaging the actuator. Preferably, first annular groove 46 is disposed between a pair of ridges 56*a* and 56*b* protruding from inner surface 44 of bushing 40 and adjacent first o-ring 48 carried in the first annular groove.

During manufacturing, bushing 40 can be assembled with latch pan 10 simply by using the actuator hole in the latch pan without having to counter-bore or further machine the latch pan. Accordingly, this invention provides for a bushing that can be installed in existing latch pans without the need to further counter-bore or otherwise machine the latch pan so that a weather resistant seal assemble is provided for aiding in protecting the interior of containers.

While a preferred embodiment of the invention has been described using specific terms, such description is for illustrative purposes only, and it is to be understood that changes and variations may be made without departing from the spirit or scope of the following claims.

What is claimed is:

1. A weather resistant latch handle assembly for installation in a compartment door for actuating a latch mechanism, said latch handle assembly comprising:

a pan having a perimeter flange, at least one sidewall, said at least one sidewall having an opening from an interior side of said pan to an exterior side of said pan, a pan floor, and a recessed area defined by said at least one sidewall and said pan floor;

a bushing carried in said opening having an inner surface for receiving an actuator which extends from said exterior side of said pan to said interior side, and an outer surface for engaging said sidewall;

a first annular groove included in said inner surface of said bushing;

a second annular groove included in said outer surface of said bushing;

a first o-ring carried by said first annular groove for engaging said actuator to form a seal between the inner surface of the bushing and the actuator;

at least one spacing member disposed between said inner surface of said bushing and said actuator for limiting compression of said first o-ring by said actuator to prevent damage to said first o-ring;

a second o-ring carried in said second annular groove for engaging said exterior side of said sidewall to form a seal between the bushing and the sidewall; and, a handle affixed to said actuator for rotating said actuator to operate said latch mechanism.

2. The latch handle assembly of claim 1 wherein said at least one spacing member is a knot protruding from said inner surface of said bushing and engaging said actuator.

3. The latch handle assembly of claim 1 wherein said at least one spacing member is a ridge protruding circumferentially from said inner surface of said bushing and engaging said actuator.

4. The latch handle assembly of claim 3 wherein said first annular groove is disposed between a pair of said ridges protruding from said inner surface of said bushing and adjacent said first o-ring carried in said first annular groove.

5. The latch handle assembly of claim 1 wherein said outer surface of said bushing includes a vertical face positioned in face-to-face engagement with the exterior side of said sidewall, and said second annular groove recessed in said vertical face of said outer surface adjacent said sidewall.

6. The latch handle assembly of claim 1 including an annular insert portion included in said bushing extending from the exterior side of the sidewall to the interior side.

7. The latch handle assembly of claim 6 including a securing flange radially extending outward from said annular insert portion on the interior side of said pan and engaging the interior side of the sidewall.

8. The latch handle assembly of claim 1 including a locking member carried in said recessed area of said pan for engaging said handle; said locking member having an engaged position wherein said handle is restrained within said recessed area, and a disengaged position wherein said handle is free to rotate said actuator.

9. The latch handle assembly of claim 8 including a bias member carried in said recessed area of said pan for engaging said handle when the handle is positioned in said recessed area to direct the handle out of the recessed area when said locking member is disengaged.

10. A weather resistant latch handle assembly comprising:

a pan having at least two sidewalls and a floor defining a recessed area for receiving a handle;

a bushing being carried in sidewall openings in each of said sidewalls;

each said bushing having an inner surface for receiving an actuator operatively connected to said handle and extends through each bushing and sidewall from an exterior side of said pan to an interior side;

said bushing having an outer surface with a vertical face positioned in face-to-face engagement with the exterior side of said sidewall;

a first annular groove included in each bushing being circumferentially recessed in said inner surface of said bushing;

a first o-ring carried in said first annular groove engaging said actuator to form a seal between said inner surface of each bushing and said actuator to prevent materials from passing between the bushing and said actuator;

at least one spacing member disposed between said inner surface of each bushing and said actuator for controlling movement of the actuator within the bushings to limit compression of said first o-ring by said actuator to prevent damage to said first o-ring;

a second annular groove included in each bushing being circumferentially recessed in said vertical face of said outer surface adjacent said sidewall; and, a second o-ring carried in said second annular groove engaging said exterior side of said sidewall to form a seal between said outer surface of each bushing and said sidewall to prevent materials from passing between the bushings and the sidewall.

11. The latch handle assembly of claim 10 wherein said at least one spacing member is a knot protruding from said inner surface of each bushing and engaging said actuator.

12. The latch handle assembly of claim 10 wherein said at least one spacing member is a ridge protruding circumferentially from said inner surface of each bushing and engaging said actuator.

13. The latch handle assembly of claim 12 wherein said first annular groove is disposed between a pair of said ridges protruding from said inner surface of each bushing and adjacent said first o-ring carried in said first annular groove.

14. The latch handle assembly of claim 10 including an annular insert portion included in each bushing extending from the exterior side of the sidewall to the interior side.

15. The latch handle assembly of claim 14 including a securing flange radially extending outward from said annular insert portion on the interior side of said pan and engaging the interior side of the sidewall.

16. The latch handle assembly of claim 10 including a locking member carried in said pan for engaging said handle; said locking member having an engaged position wherein said handle is restrained within said pan, and a disengaged position wherein said handle is free to rotate said actuator.

17. The latch handle assembly of claim 16 including a bias member carried in said pan for engaging said handle when the handle is positioned in said pan to direct the handle out of the pan when said locking member is disengaged.

18. A weather resistant latch handle assembly comprising:

a pan having at least one sidewall;

at least one bushing carried by said at least one sidewall for rotatably receiving an actuator that extends through said bushing and sidewall from an exterior side of said sidewall to an interior side;

an annular insert portion included in said bushing extending from said exterior side of said sidewall to said interior side;

a securing flange radially extending outward from said annular insert portion on said interior side of said pan and engaging said interior side of said sidewall;

said bushing having an inner surface receiving said actuator, and an outer surface with a vertical face positioned in face-to-face engagement with the exterior side of said sidewall;

a first annular groove included in said bushing being circumferentially recessed in an inner surface of said bushing adjacent said actuator;

a first o-ring carried in said first annular groove engaging said actuator to form a seal between the inner surface of the bushing and the actuator to prevent materials from passing between the bushing and the actuator;

a second annular groove included in said bushing being circumferentially recessed in said vertical face of said outer surface adjacent said sidewall; and, a second o-ring carried in said second annular groove engaging said exterior side of said sidewall to form a seal between the outer surface of the bushing and the sidewall to prevent materials from passing between the bushing and the sidewall;

at least one spacing member disposed between said inner surface of said busing and said actuator for limiting compression of said first o-ring by said actuator to prevent damage to said first o-ring.

19. The latch handle assembly of claim 18 wherein said at least one spacing member is a knot protruding from said inner surface of said bushing and engaging said actuator.

20. The latch handle assembly of claim 18 wherein said at least one spacing member is a ridge protruding circumferentially from said inner surface of said bushing and engaging said actuator.

21. The latch handle assembly of claim 20 wherein said first annular groove is disposed between a pair of said ridges protruding from said inner surface of said bushing and adjacent said first o-ring carried in said first annular groove.

* * * * *